US006168421B1

(12) United States Patent
Hsieh

(10) Patent No.: US 6,168,421 B1
(45) Date of Patent: Jan. 2, 2001

(54) SAFETY LIGHTER WITH AN IMPROVED CHILD SAFETY ASSEMBLY

(75) Inventor: Ron Shaorong Hsieh, Anaheim, CA (US)

(73) Assignee: Easton Enterprises, Inc., Anaheim, CA (US)

( * ) Notice: Under 35 U.S.C. 154(b), the term of this patent shall be extended for 0 days.

(21) Appl. No.: 09/561,641

(22) Filed: May 2, 2000

(51) Int. Cl.[7] ..... F23Q 2/46
(52) U.S. Cl. ..... 431/153; 431/273; 431/277
(58) Field of Search ..... 431/153, 273, 431/274, 276, 277

(56) References Cited

U.S. PATENT DOCUMENTS 5,096,414 3/1992 Zellweger .
5,547,370 8/1996 Hwang .
5,759,023 * 6/1998 Jenlis ..... 431/153
5,868,561 2/1999 Rogelet .
5,913,674 6/1999 Shimizu .
5,971,749 * 10/1999 Chen ..... 431/153

* cited by examiner

*Primary Examiner*—Ira S. Lazarus
*Assistant Examiner*—Sara Clarke
(74) *Attorney, Agent, or Firm*—Thomas I. Rozsa; Tony D. Chen; Jerry Fong

(57) ABSTRACT

A safety lighter with a safety strike wheel assembly including a center strike wheel, two side turning wheels which are fixedly mounted with the center strike wheel, and two driving wheels which are respectively and loosely mounted to the two side turning wheels. Each side turning wheel has an external toothed surface adapted to be inserted into the strike wheel to secure the two turning wheels to the strike wheel. To operate the safety lighter, a user must press on the driving wheels to have them frictional engage with the two side turning wheels to turn the strike wheel to create a spark.

21 Claims, 2 Drawing Sheets

SAFETY LIGHTER WITH AN IMPROVED CHILD SAFETY ASSEMBLY

BACKGROUND OF THE INVENTION

1. Field of the Invention

The present invention generally relates to the field of disposable lighters. More particularly, the present invention relates to the field of gas lighters having an improved child safety strike wheel assembly for preventing children under five years old from igniting the lighter.

2. Description of the Prior Art

Specifically, conventional disposable and non-disposable gas lighters are well known in the art. It is known that small children love to play with gas lighters, but that this may result in bums or even fires. Therefore, there is a need to incorporate a safety feature with conventional gas lighters to make them more difficult to ignite by children.

U.S. Pat. No. 5,096,414 issued to Zellweger on Mar. 17, 1992 for "Cigarette Lighter" discloses a cigarette lighter which includes a fuel well, a burner, a manually actuated igniting device, and an actuating element acting on the igniting device. The actuating element is disposed between two projecting portions for preventing the actuating element from being. reached by the finger of a child, but permitting it to be actuated by the finger of an adult because of the deformation of the pulp of the adult's finger.

U.S. Pat. No. 5,547,370 issued to Hwang on Aug. 20, 1996 for "Safety Striker Wheel Assembly For Gas Lighters" discloses a striker wheel assembly which includes a wheel axle mounted between two upright supports at the top of a butane wheel, two driving wheels mounted around the wheel axle between the upright supports, and a striker wheel fixedly mounted around the wheel axle and disposed in contact with a spring-supported flint below and turned by the driving wheels through the wheel axle to strike the spring-supported flint in producing sparks.

U.S. Pat. No. 5,868,561 issued to Rogelet on Feb. 9, 1999 for "Gas Lighter Comprising A Safety Ignition System" discloses a gas lighter which includes a reservoir for containing liquefied petroleum gas, a valve mounted on the reservoir and permitting gas to leave the reservoir, a mechanism for opening the valve, an ignition system for including an axle and a flint cooperating with a spark wheel rotationally operated by at least one circular operating wheel mounted coaxially with the spark wheel.

U.S. Pat. No. 5,913,674 issued to Shimizu on Jun. 22, 1999 for "Safety Lighter" discloses a safety lighter which includes two wheel axles that can be easily and firmly engaged with two sides of a spark wheel respectively, so to properly support the spark wheel on top of the flint and to ensure the spark wheel is absolutely driven by the two wheel axles.

It is desirable to design and construct an improved safety lighter which includes a child safety strike wheel assembly which not only makes the safety lighter difficult to ignite and thereby reduces the injuries and damages resulting from children playing with the lighters, but also easy to use and simple in construction and thereby minimizes the cost of manufacturing the safety lighters with the child safety strike wheel assembly feature.

SUMMARY OF THE INVENTION

The present invention is an improved safety lighter with a safety strike wheel assembly.

The safety lighter is conventional in the art and it incorporates the safety strike wheel assembly thereto. The safety strike wheel assembly comprises a center strike wheel, two side turning wheels which are fixedly mounted with the center strike wheel, and two driving wheels which are respectively and loosely mounted to the two side turning wheels. Each side turning wheel has an external toothed surface. The unique feature of the safety strike wheel assembly is that it is easy to assemble because of the strike wheel is made of hard material, such as steel, while the two side turning wheels are made of soft material, such as aluminum, where the soft material deforms against the hard material, thereby providing an improved locking mechanism when the two side turning wheels are fixedly mounted to the strike wheel. To operate the safety lighter, a user must press on the driving wheels to have them frictional engage with the two side turning wheels to turn the strike wheel to create a spark.

It is an object of the present invention to provide a safety lighter with an improved safety strike wheel assembly, which is easily operated by an adult, but very difficult to use by a child especially a child of less than five years old.

It is also an object of the present invention to provide a safety lighter with an improved strike wheel assembly having two side turning wheels which can be easily and firmly engaged to two opposite sides of a spark wheel respectively, so as to properly support the spark wheel on top of a flint and to ensure the spark wheel being absolutely driven by two driving wheels which are respectively and loosely mounted on the two side turning wheels.

It is an additional object of the present invention to provide a safety lighter with an improved strike wheel assembly, wherein the strike wheel is made of a hard material while the two side turning wheels are made of a soft material, where the soft material deforms against the hard material, thereby providing an improved locking mechanism when the two side turning wheels are fixedly mounted to the strike wheel.

It is a further object of the present invention to provide a safety lighter with an improved strike wheel assembly, such that a user must press on the driving wheels to have them respectively frictional engage with two side turning wheels to turn the strike wheel to create a spark.

It is still a further object of the present invention to provide a safety lighter which is simple in construction, easy to use and low manufacturing cost.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
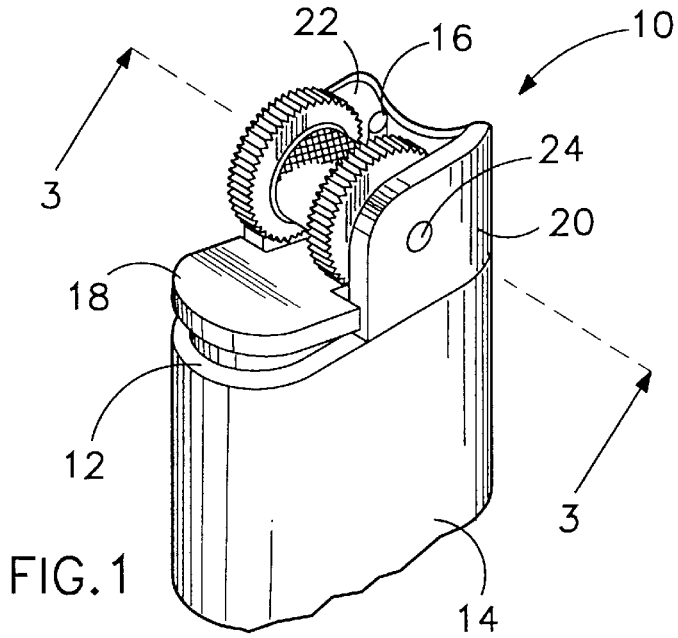
FIG. 1 is a perspective view of a preferred embodiment of the present invention safety lighter with a safety strike wheel assembly.
Figure 3:
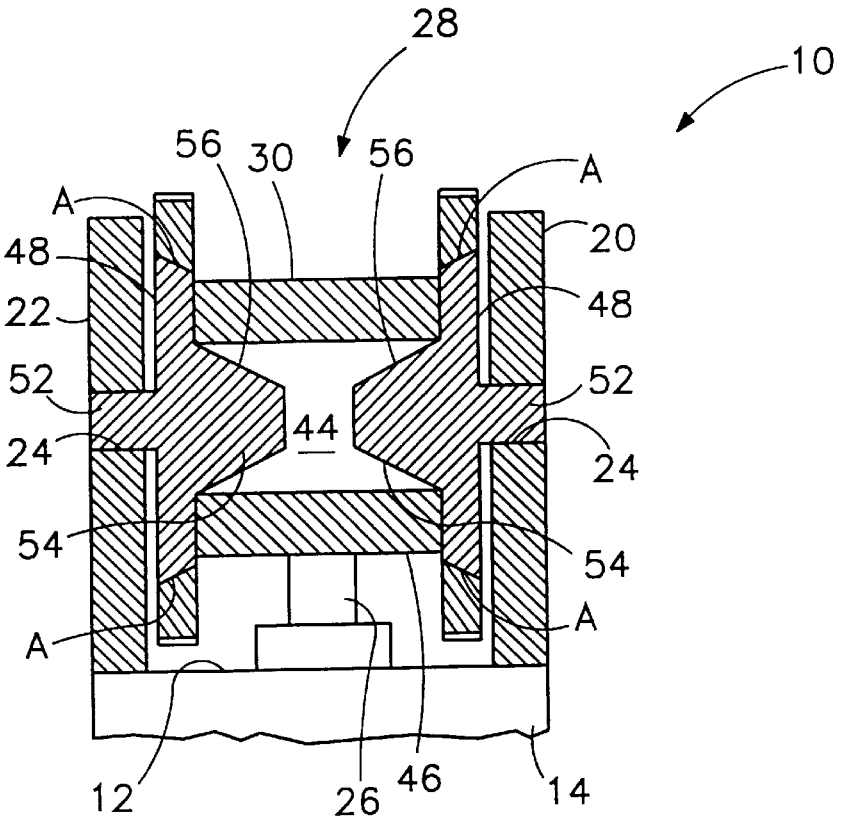
FIG. 3 is a partial cross-sectional view taken along line 3—3 of FIG. 1.

Referring to FIGS. 1 and 3, there is shown at 10 the present invention safety lighter which comprises a supporting frame 12 disposed on top of a gas reservoir housing 14. The gas reservoir housing 14 has a valve or flame nozzle 16 which is actuated by a gas lever 18 pivotally mounted on the supporting frame 12 for actuating the valve 16 to release gas within the gas reservoir housing 14. The supporting frame 12 has two upright supporting walls 20 and 22 parallel protruding on opposite sides of the gas lever 18. Each of the supporting walls 20 and 22 has a supporting hole 24 provided thereon. Flint means 26 extends upwardly from the supporting frame 12 and between the two upright supporting walls 20 and 22.

Figure 2:
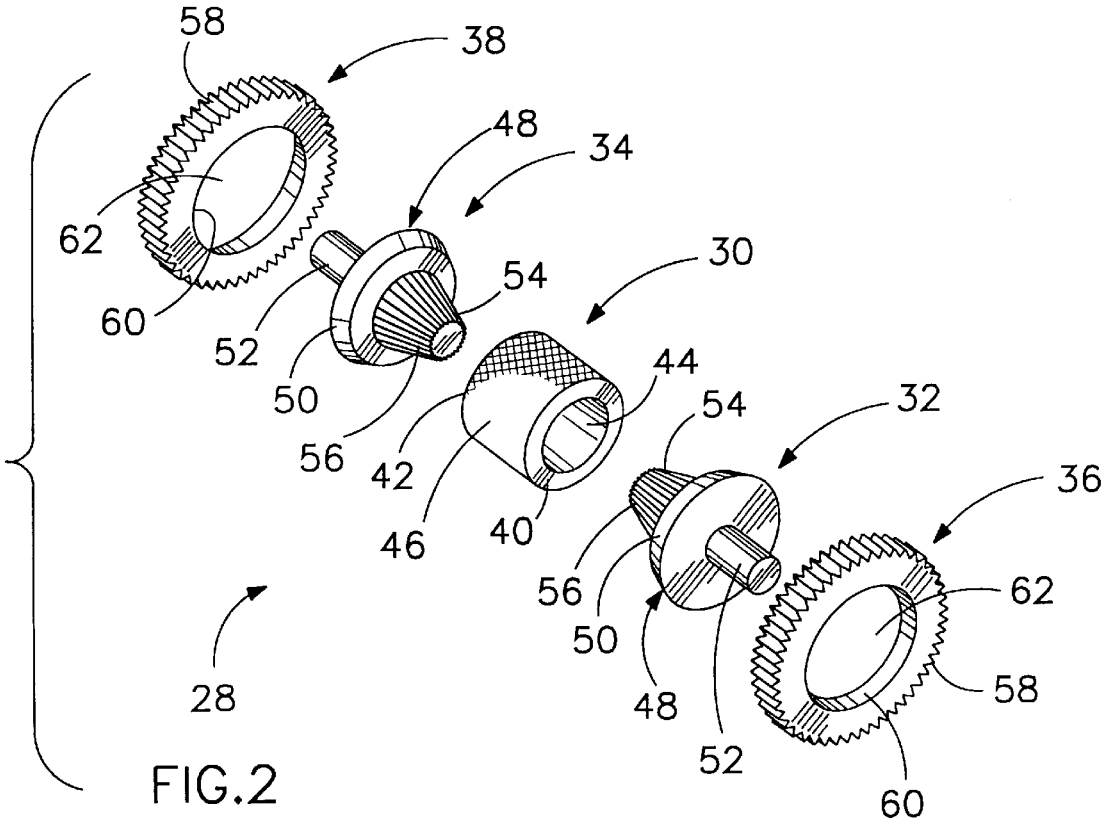
FIG. 2 is an enlarged exploded view of the safety strike wheel assembly of the present invention safety lighter.

Referring to FIG. 2, there is shown at 28 a safety strike wheel assembly which includes a uniform center strike wheel 30, a pair of side turning wheels 32 and 34, and a pair of driving rings or wheels 36 and 38. The strike wheel 30 has a first axle hole end 40, a second axle hole end 42, an internal bore 44 extending therethrough from the axle hole ends 40 and 42, and an external striking surface 46 in contact with the flint means 26, wherein the flint means 26 is retained urging against the striking surface 46 for generating a spark directed toward the valve 16 when the striking surface 46 is driven to strike against the flint means 26 (see FIG. 3).

Referring to FIGS. 2 and 3, each of the side turning wheels 32 and 34 has a wheel portion 48 with a bevel rim 50, a protruding axle portion 52 centrally located on one side of the wheel portion 48, and a protruding frusto-conical attachment portion 54 centrally located on the other side of the wheel portion 48 and tapered therefrom. Each protruding frusto-conical attachment portion 54 has an external toothed surface 56 adapted for improved locking engagement. Each protruding frusto-conical attachment portion 54 is respectively inserted into the axle hole ends 40 and 42 of the strike wheel 30 such that the external toothed surfaces 56 deform against and engage the surface of the internal bore 44 of the strike wheel 30 to secure the side turning wheels 32 and 34 to the strike wheel 30. This unique feature provides an adjustable attachment feature for the side turning wheels 32 and 34 to the strike wheel 30. The uniqueness of this is that the strike wheel 30 is made out of steel material while the side turning wheels 32 and 34 are made of aluminum material so when the frusto-conical attachment portions 54 are inserted into the axle hole ends 40 and 42 of the internal bore 44 of the striking wheel 30, the external toothed surfaces 56 deform against the surface of the internal bore 44 to secure the side turning wheels 32 and 34 to the strike wheel 30.

Each of the driving rings 36 and 38 has an external knurling surface 58 adapted for better contact by a user and an internal bevel rim 60 surrounding a central driving hole 62. The central driving holes 62 have a diameter slightly larger than the wheel portions 48 of the two turning wheels 32 and 34, where the driving rings 36 and 38 are respectively and loosely mounted on the turning wheels 32 and 34. The internal bevel rims 60 of the driving rings 36 and 38 respectively correspond to the bevel rims 50 of the wheel portions 54 of the two turning wheels 32 and 34. The bevel rims 60 of the driving rings 36 and 38 can be loosely rotated around the bevel rims 50 of the side turning wheels 32 and 34 respectively without being depressed, thereby when a depressing force is applied downwardly to the driving rings 36 and 38 which in turn depress and turn the turning wheels 32 and 34, so that the frusto-conical portions 54 of the turning wheels 32 and 34 are pressed to engage with the strike wheel 30 to drive and strike the striking surface 46 against the flint means 26. The angle "A" of the bevel rim 50 of the wheel portion 48 of each of two side turning wheels 32 and 34 is greater than 5°. In addition, the internal bevel rim 60 of each of the driving rings 36 and 38 is also 5°. Larger than 5° angle on the bevel rim 50 of each of the side turning wheels 32 and 34 makes the driving wheels 36 and 38 close to center. The 5° angle "A" will make molding process easier, resulting in higher output and lower defects and therefore will help reduce production cost. Furthermore, bevel rim 50 may have a smooth surface as shown, or alternatively may have a rough or teethed surface.

To operate the safety lighter 10, a user must press on the two driving rings 36 and 38 to have them frictional engage with the two side turning wheels 32 and 34, respectively, to turn the strike wheel 30 so that the striking surface 46 strikes the flint means 26 to create a spark. The friction force needed to operate the safety lighter 10 can be preset by adjusting the hardness of the material and roughness of the contacting surface between the driving rings 36 and 38, and the strike wheel assembly 28. Therefore, children may not have sufficient force to press the driving rings to turn the safety strike wheel assembly 28.

The present invention conforms to conventional forms of manufacture or any other conventional way known to one skilled in the art, and is of simple construction and is easy to use.

Figure 4:
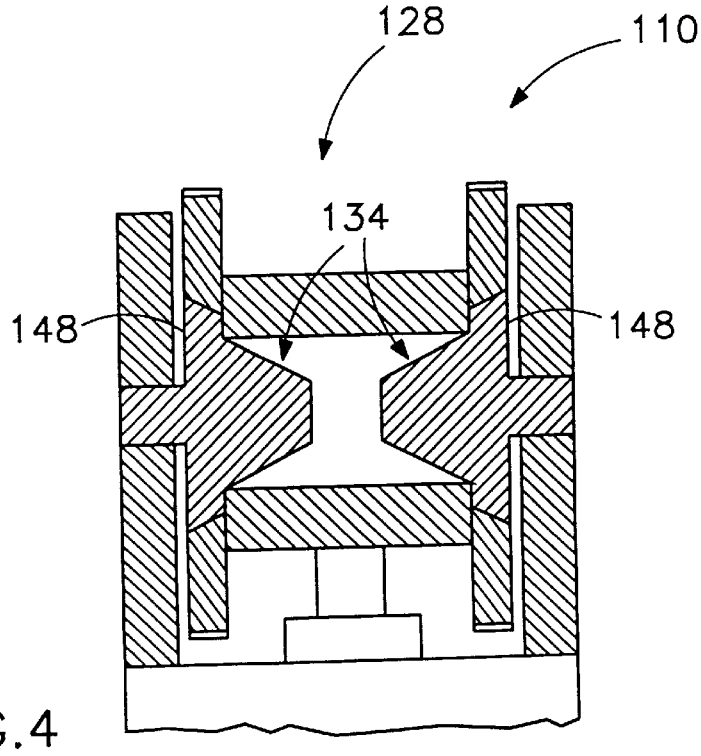
FIG. 4 is a partial cross-sectional view similar to FIG. 3, showing an alternative embodiment of a safety strike wheel assembly of the present invention safety lighter.

Referring to FIG. 4, there is shown at 128 an alternative embodiment of the safety strike wheel assembly of the present invention safety lighter 110. This embodiment is very similar to the preceding embodiment just discussed above and the only difference is the nature and configuration of side turning wheels 134. All of the parts of this embodiment are numbered correspondingly with 100 added to each number.

Since it assembles and functions the same as previously described above except that the wheel portion 148 of each of the two side turning wheels 134 has a smaller diameter than the preceding embodiment discussed above, and the description thereof will not be repeated.

Defined in detail, the present invention is a safety lighter comprising: (a) a supporting frame disposed on top of a gas reservoir housing having a valve which is actuated by a gas lever pivotally mounted on the supporting frame for actuating the valve to release gas within the gas reservoir housing, the supporting, frame having two upright supporting walls parallel protruding on opposite sides of the gas lever and each supporting wall having a supporting hole thereon; (b) flint means extending upwardly from the supporting frame and between the two upright supporting walls; (c) a strike wheel having a first axle hole end, a second axle hole end, an internal bore extending between the axle hole ends and an external striking surface in contact with the flint means, wherein the flint means is retained urging against the striking surface for generating sparks directed toward the valve when the striking surface is driven to strike against the flint means; (d) a pair of side turning wheels each having a wheel portion with a bevel rim, a protruding axle portion centrally located on one side of the wheel portion for rotatably inserting into the respective supporting hole, and a protruding frusto-conical attachment portion centrally located on the other side of the wheel portion and tapered therefrom, the protruding frusto-conical attachment portion having an external toothed surface respectively inserted into the axle hole ends of the strike wheel such that the external toothed surface of the protruding frusto-conical attachment portion of the each side turning wheel en-ages with the internal bore of the strike wheel to secure the pair of side turning wheels to the striking, wheel; and (e) a pair of driving, rings each having an external knurling surface and an internal bevel rim surrounding a central driving hole, the central driving hole having a diameter slightly larger than the wheel portion of the each side turning wheel, where the internal bevel rim is respectively and loosely mounted on and corresponds to the bevel rim of the each side turning wheel, so to engage the bevel rim of the each side turning wheel to loosely rotate around the each side turning wheel without being, depressed, thereby when a depressing force is applied downwardly to the pair of driving rings which in turn depress and turn the pair of side turning wheels, so that the frusto-conical attachment portion is respectively pressed to engage with the strike wheel to drive and strike against the flint means; (f) whereby to operate the safety lighter, a user must press on the pair of driving rings to have them frictional engage with the pair of axle wheels respectively to turn the strike wheel so that the striking, surface strikes the flint means to create a spark.

Defined broadly, the present invention is a safety lighter, comprising: (a) a supporting frame disposed on top of a gas reservoir housing having a valve which is actuated by a gas lever for actuating the valve to release gas within the gas reservoir housing, the supporting frame having two upright supporting walls on opposite sides of the gas lever and each supporting wall having a supporting hole thereon; (b) flint means extending upwardly from the supporting frame; (c) a strike wheel having an internal bore extending therethrough and an external striking surface in contact with the flint means, wherein the flint means is retained urging against the striking surface for generating sparks directed toward the valve when the striking surface is driven to strike against the flint means; (d) at least two axle wheels each having a wheel portion with a bevel rim, an axle portion located on one side of the wheel portion for rotatably inserting into the respective supporting hole, and a frusto-conical portion located on the other side of the wheel portion, the frusto-conical portion having an external toothed surface respectively inserted into the internal bore of the strike wheel at opposite ends such that the external toothed surface of the frusto-conical portion of the each axle wheel engages with the internal bore of the strike wheel to secure the at least two axle wheels to the strike wheel; and (e) at least two driving rings each having an internal bevel rim surrounding a driving hole, where the internal bevel rim is respectively and loosely mounted on and corresponds to the bevel rim of the each axle wheel, so to engage the bevel rim of the each axle wheel to loosely rotate around the each axle wheel without being depressed, thereby when a depressing force is applied downwardly to the at least two driving rings which in turn depress and turn the at least two axle wheels, so that the frusto-conical portions are pressed to engage with the strike wheel to drive and strike against the flint means; (f) whereby to operate the safety lighter, a user must press on the at least two driving rings to have them frictional engage with the at least two axle wheels respectively to turn the strike wheel so that the striking surface strikes the flint means to create a spark.

Defined more broadly, the present invention is a safety strike wheel assembly used in conjunction with a lighter, comprising: (a) a strike wheel having an internal bore extending therethrough and an external striking surface being in contact with flint means for generating sparks directed toward a valve when the striking surface is driven to strike against the flint means; (b) at least two axle wheels each having a wheel portion with a bevel rim, an axle portion located on one side of the wheel portion for rotatably inserting into a respective supporting hole of the lighter, and a frusto-conical portion located on the other side of the wheel portion, the frusto-conical portion having an external toothed surface respectively inserted into the internal bore of the strike wheel at opposite ends such that the external toothed surface respectively engages with the internal bore of the strike wheel to secure the at least two axle wheels to the strike wheel; and (c) at least two driving rings each having an internal bevel rim surrounding a driving hole, where the internal bevel rim is respectively and loosely mounted on and corresponds to the bevel rim of the each axle wheel, so to engage the bevel rim of the each axle wheel to loosely rotate around the each axle wheel without being depressed, thereby when a depressing force is applied downwardly to the at least two driving rings which in turn depress and turn the at least two axle wheels, so that the frusto-conical attachment portion is respectively pressed to engage with the strike wheel to drive and strike against the flint means; (d) whereby to operate the safety striking wheel assembly, a user must press on the at least two driving rings to have them frictional engage with the at least two axle wheels respectively to turn the strike wheel so that the striking surface strikes the flint means to create a spark.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A safety lighter, comprising:

a. a supporting frame disposed on top of a gas reservoir housing having a valve which is actuated by a gas lever pivotally mounted on the supporting frame for actuating the valve to release gas within the gas reservoir housing, the supporting frame having two upright supporting walls parallel protruding on opposite sides of the gas lever and each supporting wall having a supporting hole thereon;

b. flint means extending upwardly from said supporting frame and between said two upright supporting walls;

c. a strike wheel having a first axle hole end, a second axle hole end, an internal bore extending between the axle hole ends and an external striking surface in contact with said flint means, wherein said flint means is retained urging against the striking surface for generating sparks directed toward said valve when the striking surface is driven to strike against said flint means;

d. a pair of side turning wheels each having a wheel portion with a bevel rim, a protruding axle portion centrally located on one side of the wheel portion for rotatably inserting into said respective supporting hole, and a protruding frusto-conical attachment portion centrally located on the other side of the wheel portion and tapered therefrom, the protruding frusto-conical attachment portion having an external toothed surface respectively inserted into said axle hole ends of said strike wheel such that the external toothed surface of said protruding frusto-conical attachment portion of said each side turning wheel engages with said internal bore of said strike wheel to secure the pair of side turning wheels to said striking wheel; and e. a pair of driving rings each having an external knurling surface and an internal bevel rim surrounding a central driving hole, the central driving hole having a diameter slightly larger than said wheel portion of said each side turning wheel, where the internal bevel rim is respectively and loosely mounted on and corresponds to said bevel rim of said each side turning wheel, so to engage said bevel rim of said each side turning wheel to loosely rotate around said each side turning wheel without being depressed, thereby when a depressing force is applied downwardly to the pair of driving rings which in turn depress and turn said pair of side turning wheels, so that said frusto-conical attachment portion is respectively pressed to engage with said strike wheel to drive and strike against said flint means;

f. whereby to operate said safety lighter, a user must press on said pair of driving rings to have them frictional engage with said pair of axle wheels respectively to turn said strike wheel so that said striking surface strikes said flint means to create a spark.

2. The safety lighter in accordance with claim 1, wherein said strike wheel is made out of steel material.

3. The safety lighter in accordance with claim 1, wherein said each side turning wheel is made out of aluminum material so when said frusto-conical attachment portion of said each side turning wheel is respectively inserted into said internal bore of said strike wheel, said external toothed surface deforms against said internal bore to secure said each side turning wheel thereto.

4. The safety lighter in accordance with claim 1, wherein the angle of said bevel rim of said wheel portion of said each side turning wheel is greater than 5°.

5. The safety lighter in accordance with claim 1, wherein the angle of said internal bevel rim of said each driving ring is greater than 5°.

6. The safety lighter in accordance with claim 1, wherein said bevel rim of said each turning wheel has a smooth surface.

7. The safety lighter in accordance with claim 1, wherein said bevel rim of said each turning wheel has a teethed surface.

8. A safety lighter, comprising:

a. a supporting frame disposed on top of a gas reservoir housing having a valve which is actuated by a gas lever for actuating the valve to release gas within the gas reservoir housing, the supporting frame having two upright supporting walls on opposite sides of the gas lever and each supporting wall having a supporting hole thereon;

b. flint means extending upwardly from said supporting frame;

c. a strike wheel having an internal bore extending therethrough and an external striking surface in contact with said flint means, wherein said flint means is retained urging against the striking surface for generating sparks directed toward said valve when the striking surface is driven to strike against said flint means;

d. at least two axle wheels each having a wheel portion with a bevel rim, an axle portion located on one side of the wheel portion for rotatably inserting into said respective supporting hole, and a frusto-conical portion located on the other side of the wheel portion, the frusto-conical portion having an external toothed surface respectively inserted into said internal bore of said strike wheel at opposite ends such that the external toothed surface of said frusto-conical portion of said each axle wheel engages with said internal bore of said strike wheel to secure the at least two axle wheels to said strike wheel; and e. at least two driving rings each having an internal bevel rim surrounding a driving hole, where the internal bevel rim is respectively and loosely mounted on and corresponds to said bevel rim of said each axle wheel, so to engage said bevel rim of said each axle wheel to loosely rotate around said each axle wheel without being depressed, thereby when a depressing force is applied downwardly to the at least two driving rings which in turn depress and turn said at least two axle wheels, so that said frusto-conical portions are pressed to engage with said strike wheel to drive and strike against said flint means;

f. whereby to operate said safety lighter, a user must press on said at least two driving rings to have them frictional engage with said at least two axle wheels respectively to turn said strike wheel so that said striking surface strikes said flint means to create a spark.

9. The safety lighter in accordance with claim 8, wherein said strike wheel is made out of steel material.

10. The safety lighter in accordance with claim 8, wherein said each axle wheel is made out of aluminum material so when said frusto-conical portion of said each axle wheel is inserted into said internal bore of said strike wheel, said external toothed surface deforms against said internal bore to secure said each axle wheel thereto.

11. The safety lighter in accordance with claim 8, wherein the angle of said bevel rim of said wheel portion of said each side axle wheel is greater than 5°.

12. The safety lighter in accordance with claim 8, wherein the angle of said internal bevel rim of said each driving ring is greater than 5°.

13. The safety lighter in accordance with claim 8, wherein said driving hole of said each driving ring has a diameter slightly larger than said wheel portion of said each axle wheel.

14. The safety lighter in accordance with claim 8, wherein said each driving ring further comprises an external knurling surface adapted for better contact to a user finger.

15. A safety strike wheel assembly used in conjunction with a lighter, comprising:

a. a strike wheel having an internal bore extending therethrough and an external striking surface being in contact with flint means for generating sparks directed toward a valve when the striking surface is driven to strike against the flint means;

b. at least two axle wheels each having a wheel portion with a bevel rim, an axle portion located on one side of the wheel portion for rotatably inserting into a respective supporting hole of said lighter, and a frusto-conical portion located on the other side of the wheel portion, the frusto-conical portion having an external toothed surface respectively inserted into said internal bore of said strike wheel at opposite ends such that the external toothed surface respectively engages with said internal bore of said strike wheel to secure the at least two axle wheels to said strike wheel; and c. at least two driving rings each having an internal bevel rim surrounding a driving hole, where the internal bevel rim is respectively and loosely mounted on and corresponds to said bevel rim of said each axle wheel, so to engage said bevel rim of said each axle wheel to loosely rotate around said each axle wheel without being depressed, thereby when a depressing force is applied downwardly to the at least two driving rings which in turn depress and turn said at least two axle wheels, so that said frusto-conical attachment portion is respectively pressed to engage with said strike wheel to drive and strike against said flint means;

d. whereby to operate said safety striking wheel assembly, a user must press on said at least two driving rings to have them frictional engage with said at least two axle wheels respectively to turn said strike wheel so that said striking surface strikes said flint means to create a spark.

16. The strike wheel assembly in accordance with claim 15, wherein said strike wheel is made out of steel material.

17. The strike wheel assembly in accordance with claim 15, wherein said each axle wheel is made out of aluminum material so when said frusto-conical portion of said each axle wheel is respectively inserted into said internal bore of said strike wheel, said external toothed surface deforms against said internal bore to secure said each axle wheel thereto.

18. The strike wheel assembly in accordance with claim 15, wherein the angle of said bevel rim of said wheel portion of said each axle wheel is greater than 5°.

19. The strike wheel assembly in accordance with claim 15, wherein the angle of said internal bevel rim of said each driving ring is greater than 5°.

20. The strike wheel assembly in accordance with claim 15, wherein said driving hole of said each driving ring has a diameter slightly larger than said wheel portion of said each axle wheel.

21. The strike wheel assembly in accordance with claim 15, wherein said each driving ring further comprises an external knurling surface adapted for better contact to a user finger.

* * * * *